US006272716B1

(12) United States Patent
Thornton

(10) Patent No.: US 6,272,716 B1
(45) Date of Patent: Aug. 14, 2001

(54) HAND-HELD TOILET PAPER GRIPPING DEVICE

(76) Inventor: Kent J. Thornton, 3719 Western Branch Blvd., Portsmouth, VA (US) 23707

( * ) Notice: Subject to any disclaimer, the term of this patent is extended or adjusted under 35 U.S.C. 154(b) by 0 days.

(21) Appl. No.: 09/257,181

(22) Filed: Feb. 25, 1999

Related U.S. Application Data

(60) Provisional application No. 60/076,355, filed on Feb. 27, 1998.

(51) Int. Cl.[7] ..... A47K 7/04; A47K 7/08

(52) U.S. Cl. ..... 15/210.1; 15/150

(58) Field of Search ..... 15/209.1, 210.1, 15/220.1, 150; 604/1; 294/19.1

(56) References Cited

U.S. PATENT DOCUMENTS

D. 279,924 7/1985 Osgood .
756,100 * 3/1904 Crumb .
1,818,388 8/1931 Farley .
2,320,967 * 6/1943 Dunkelberger .
2,579,536 * 12/1951 Barr .
3,019,447 2/1962 Sluz .
4,260,186 * 4/1981 Sky-Eagle, Jr. .
4,570,274 2/1986 Kaneko et al. .
4,890,340 1/1990 Lovitt .
4,987,634 * 1/1991 Weihrauch .
5,569,274 10/1996 Rapacki et al. .
5,630,243 * 5/1997 Federico .

* cited by examiner

*Primary Examiner*—Randall E. Chin
(74) *Attorney, Agent, or Firm*—Richard C. Litman

(57) ABSTRACT

A hand-held device for gripping a piece of toilet paper including a pair of opposing jaws that are attached to one end of a curved tubular body, and a handle, with a push button actuator for the jaws, that is attached to the opposite end of the tubular body. The device provides a person with a way to easily and conveniently clean the anal region minimizing the chance of exposing themselves to the potential health risks associated with contacting fecal matter. Additionally, the device may be sterilized by chemical or thermal methods.

6 Claims, 2 Drawing Sheets

HAND-HELD TOILET PAPER GRIPPING DEVICE

CROSS-REFERENCE TO RELATED APPLICATION

This application claims the benefit of U.S. Provisional Patent Application Ser. No. 60/076,355, filed Feb. 27, 1998.

BACKGROUND OF THE INVENTION

1. Field of the Invention

The present invention relates to hygienic devices and, in particular, to a hand-held device for gripping a piece of toilet paper which allows a physically challenged person to clean their anal region with comfort and convenience.

2. Description of Related Art

Throughout history, the sanitary removal of fecal matter from the anal region has been of prime importance. Despite the progress in all fields of our standard of living and particularly the improvements in the field of hygiene, few changes have occurred in the method of cleaning the anus. The traditional method of using toilet paper requires the individual to hold the toilet paper in their hand while attempting to clean the anal region. This creates a potential health risk by exposing the person's hands to fecal matter. Also, some individuals, such the obese or physically challenged, may lack a sufficient range of motion in their arms or shoulders to reach behind themselves to their anal region.

In order to overcome some of the above problems, hand-held bidets were developed to spray a stream of water at the anal region, thereby flushing away any fecal matter (e.g., U.S. Pat. No. 4,570,274, Kaneko et al., and, Des. 279,924, Osgood). However, since these devices spray a stream of water, they can be messy or difficult to use, especially for a person that is physically challenged in some fashion.

In order to overcome the above mentioned problems, there is a need for a hand-held device which will grip a piece of toilet paper and will extend the reach of the user's arm, thereby allowing the person to easily and conveniently clean their anal region thereby minimizing the chance of exposing themselves to the potential health risks of contacting fecal matter.

Although inventions of similar appearance exist, none are functionally or structurally designed to accomplish the presently described purposes. For example, U.S. Pat. No. 5,569,274 discloses an endoscopic vascular clamping system and method. This is device is for temporally occluding a blood vessel and not for hygienic purposes.

U.S. Pat. No. 4,890,340 discloses a self-contained hand-held bidet. However, this device does not allow the user to grip a piece of toilet paper.

U.S. Pat. No. 3,019,447 discloses an apparatus for douching the anus that is attached to a water source by a plastic hose. Again, the device does not hold a piece of toilet paper.

U.S. Pat. No. 1,818,388 discloses a device for cleaning the anal region comprising a spray head that is attached to a water source.

None of the above inventions and patents, taken either singly or in combination, is seen to describe the instant invention as claimed.

SUMMARY OF THE INVENTION

In view of the foregoing limitations of hygienic devices described in the related art, the present invention provides an improved hand-held toilet paper gripping device that will grip a piece of toilet paper and will extend the reach of the users arm. Accordingly, a user can easily and conveniently clean their anal region, thereby minimizing the chance of exposing themselves to the potential health risks of contacting fecal matter.

The hand-held toilet paper gripping device includes a curved tubular body portion having a first body end and a second body end, a toilet tissue gripping apparatus, a handle, and a jaw actuating mechanism. The curved tubular body portion is made from a rigid, yet resilient, material so that the curved tubular body portion will not flex except if an amount of pressure is exerted which is potentially harmful to the user. The curved tubular body portion is used to extend the reach of a user.

The toilet tissue gripping apparatus is affixed to the second body end enabling the hand-held toilet paper gripping device to grip toilet tissue at the second body end. The handle is affixed to the first body end for handling the hand-held toilet paper gripping device. The jaw actuating mechanism is attached to the handle, the curved tubular body portion, and the toilet tissue gripping apparatus in a manner to selectively actuate the toilet tissue gripping apparatus between an opened position and a closed position for gripping toilet tissue.

Accordingly, it is a principal object of the invention to provide a hand-held toilet paper gripping device that will allow the user to clean the anal region in a sanitary manner.

It is another object of the invention to provide a hand-held toilet paper gripping device that extends the reach of a person's arm, thereby allowing a physically challenged person to more easily and conveniently reach the anal region.

It is a further object of the invention to provide a hand-held toilet paper gripping device that will securely grip a piece of toilet tissue.

Still another object of the invention is to provide a hand-held toilet paper gripping device that may be disinfected by conventional methods, such as thermal or chemical disinfecting.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2:
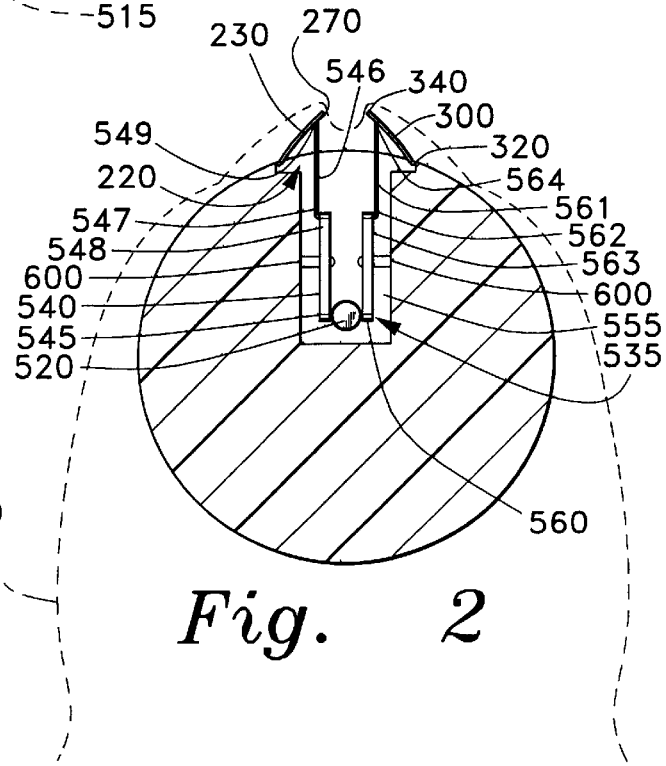
FIG. 2 is a cross sectional view drawn along lines 2—2 of FIG. 1.
Figure 3:
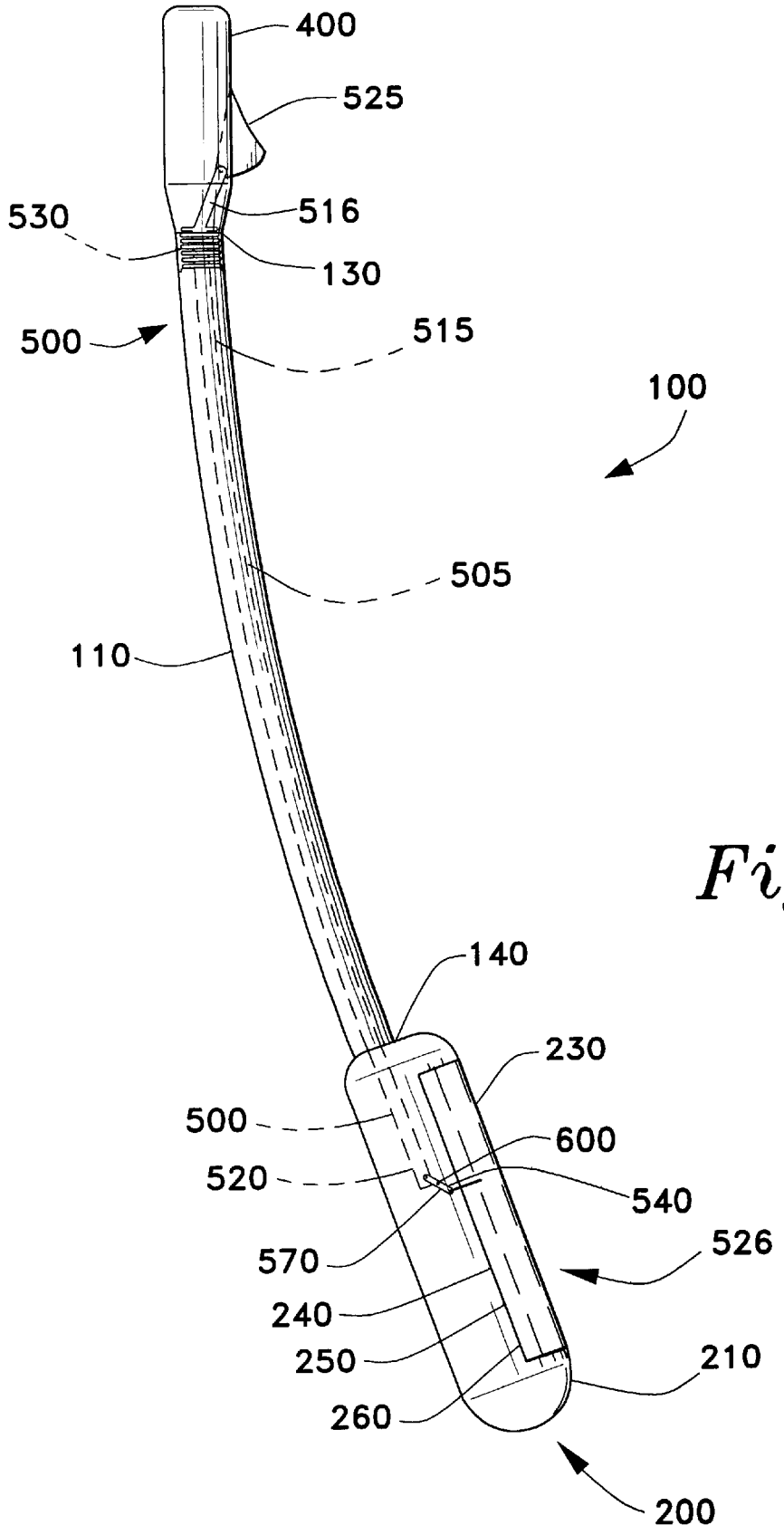
FIG. 3 is an elevational side view of a hand-held toilet paper gripping device according to the present invention showing its jaws in a closed position.

Referring first to FIGS. 2 and 3 together, a hand-held device for gripping toilet paper 100 is shown including an curved tubular body portion 110 that is defined by a first body end 130 and a second body end 140, a handle 400 that is attached to the first body end 130, and a toilet tissue gripping apparatus 200 that is attached to the second body end 140. The curved tubular body portion 110 should have sufficient rigidity so that flexion not occur unless a potentially harmful amount of pressure is exerted by the user. Materials characterized by such appropriate flexion may be determined by one of ordinary skill in art using conventional engineering methods to establish maximum and minimum bending properties. Such material choice includes plastics, molded or extruded, such as polypropylene, polyethylene, polyvinylchloride, etc. Nevertheless other materials, such as stainless tubular steel of various gauges, may also be used. In addition to flexion properties, such materials must have the appropriate surface characteristics for sterilization or resistance to antigermicidal cleaning with various solvents, such as alcohols and water, again suggesting plastics or surgical grade stainless steel as preferred choices.

The toilet paper gripping apparatus 200 includes a jaw support 210 that is attached to the second body end 140. The jaw support 210 preferably has a cylindrical configuration with a closed, generally hemispherical end, or generally ellipsoidal, to provide a continuous, smooth, rounded surface both suitable for winding a length of toilet paper thereon, as well as, to prevent possible injury or irritation to sensitive tissues when contacting the anal region during wiping. A suitable material characterized by such appropriate smoothness may be determined by one of ordinary skill in art using conventional engineering methods. Such material choice may include plastics, molded or extruded, such as polypropylene, polyethylene, polyvinylchloride, etc. Again, in addition to the property of smoothness, the chosen material must have the appropriate surface characteristics for sterilization or resistance to antigermicidal cleaning with various solvents, such as alcohols and water, again suggesting plastics or stainless steel as a preferred choice.

Figure 1:
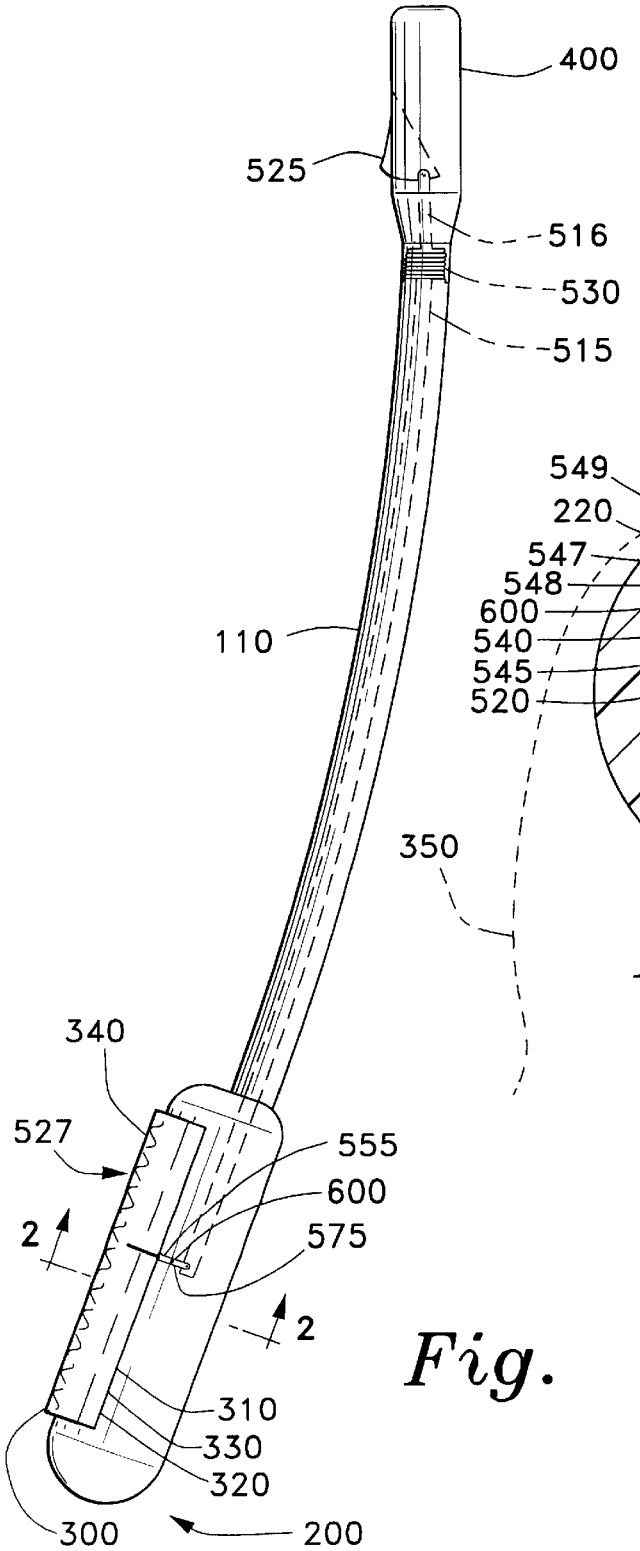
FIG. 1 is an elevational side view of a hand-held toilet paper gripping device according to the present invention showing its jaws in an open state.

The jaw support 210 defines a cavity having an opening 220, appearing rectangular when viewed in plan view, for accommodating a first opposing jaw 230 and a second opposing jaw 300. As seen in FIG. 1 and FIG. 3, each jaw 230,300 is a substantially rectangular panel which, as seen in FIG. 2, is arcuate in cross section to generally correspond to an arc of an ellipsoid. Each panel or jaw 230,300 is disposed adjacent to the other, sized and dimensioned together to cover the rectangular opening 220, to form a flush surface with the remainder of the support 210 to complete the ellipsoidal or cylindrical shape. This is important to eliminate otherwise injurious protrusions which might nick the skin or anal tissues during wiping. Thus, the first opposing jaw 230 has a first jaw edge 240 that is mounted by a first hinge 250, preferably a living hinge when plastics are used, to a first longitudinal edge 260 of the rectangular opening 220. The second opposing jaw 300 has a second jaw edge 310 that is mounted by a second hinge 320 to a second longitudinal edge 330 of the rectangular opening 220. The opposing edges of each first opposing jaw 230 and the second opposing jaw 300 thus define a first gripping edge 270 and a second gripping edge 340, respectively, for gripping a piece of toilet paper 350 therebetween as the two panels come together at a juncture where they would otherwise contiguously meet, in effect, forming a pair of doors with which to capture a portion of the toilet paper in a closed state, as suggested by FIG. 3.

As appreciated from FIGS. 1 and 3, the opening and closing of the first opposing jaw 230 and the second opposing jaw 300 is accomplished by a jaw actuating mechanism 500. A rod 505 having a first rod end 515 and a second rod end 520 is located inside the elongated tubular body portion 110. The first rod end 515 is attached to a connector 516 that extends into the handle 400, and the second rod end 520 extends into the jaw support 210. The connector 516 may be a cable or rod extending internally along and beyond the entire length of the tubular body 110.

A push button actuator 525 is built into the handle 400, and is operably attached to the connector 516. A conventionally known trigger may be chosen as an actuator, which, when the push button actuator 525 is depressed, causes the rod 505 to be displaced toward the second body end 140. A spring 530 disposed inside the first body end 130 is attached to the first rod end 515 and anchored to the tubular portion 110, which spring 530, by depressing the actuator 525, is stretched providing a biasing force to later reset the actuator and jaws. The displacement of rod 505 causes first opposing jaw 230 and second opposing jaw 300 to open by a mechanism to be discussed below. When the push button actuator 525 is released, the spring 530 returns to its non-stretched length, thereby biasing first opposing jaw 230 and second opposing jaw 300 to a closed position 526 (FIG. 3).

Jaw support 210 contains a jaw actuator 535 for opening and closing first opposing jaw 230 and second opposing jaw 300. Although any means of simultaneously opening and closing the jaws 230,300 may be adapted to the present invention by one of ordinary skill in the art, an exemplary means, as best seen in FIG. 2, of jaw actuator 535 has a first opposing connector 540 and a second opposing connector 555 mounted on a pivot arm 600 disposed in the cavity below opening 220. The first opposing connector 540 is pivotally attached to the second rod end 520 at a first jaw connector end 545. The first end 547 of a first opposing jaw extension 546 is pivotally attached to a first extension end 548 of the connector 540. A second end 549 of first opposing jaw extension 546 is attached to the first opposing jaw 230.

In an identical manner, second opposing connector 555 is pivotally attached to the second rod end 520 at a first jaw connector terminus 560. The first terminus 562 of a second opposing jaw extension 561 is pivotally attached to a first extension terminus 563 of the connector 555. A second terminus 564 of second opposing jaw extension 561 is attached to the second opposing jaw 300.

An even simpler embodiment of the jaw actuator 535 can be achieved by eliminating the pivot arms 600 and first and second opposing jaw extensions 546,561, and simply attaching the first extension end 548 and first extension terminus 563 to the first and second jaws 230,300, respectively.

Thus, as seen in FIG. 3, when the push button actuator 525 is not depressed, first opposing connector 540 (and second opposing connector 555, hidden) are both in an inclined position 570. When the push button actuator 525 is depressed, as shown in FIG. 1, both first opposing connector 540 (hidden) and second opposing connector 555 are pivoted to a raised position 575, thereby causing first opposing jaw 230 (hidden) and second opposing jaw 300 to be raised to an open position 527. The toilet paper 350 can thus be inserted between jaws 230,300 as shown in FIG. 2, and the actuator 525 released, thus closing the jaws 230,300 pinching the toilet paper therebetween. The jaw support 210 thus supports the toilet paper and presents an uninterrupted surface of toilet paper for wiping of fecal matter. Moreover, the jaws 230,300 return to a closed position flush with the rest of the surface of the jaw support 210, eliminating the risk of inadvertent nicks or irritation.

It is to be understood that the present invention is not limited to the sole embodiment described above, but encompasses any and all embodiments within the scope of the following claims.

I claim:

1. A hand-held toilet paper gripping device comprising:

a curved tubular body portion made of a substantially rigid material, said curved tubular body portion having a first body end and a second body end;

a toilet tissue gripping apparatus affixed to said second body end for grasping a sheet of toilet tissue and including:

a jaw support affixed to said second body end, said jaw support having an opening defined by a first longitudinal edge and a second longitudinal edge for accommodating a first opposing jaw and a second opposing jaw;

a first opposing jaw having a first jaw edge pivotally attached to said first longitudinal edge for enabling said first opposing jaw to open outwardly from said jaw support; and a second opposing jaw having a second jaw edge pivotally attached to said second longitudinal edge for enabling said second opposing jaw to open outwardly from said jaw support;

a handle affixed to said first body end; and a jaw actuating mechanism operably attached to each of said handle, said curved tubular body portion, and said toilet tissue gripping apparatus for selectively actuating said toilet tissue gripping apparatus between an opened position and a closed position for gripping toilet tissue.

2. The hand-held toilet paper gripping device recited in claim 1, wherein said jaw actuating mechanism comprises:

a rod, located inside said curved tubular body portion, having a first rod end and a second rod end, said first rod end being attached to a connector which extends into said handle, and said second rod end extending into said jaw support;

a push button actuator built into said handle, and pivotally attached to said connector, so that when said push button actuator is depressed, said length of said cylindrical rod is displaced toward said second body end; and a spring located inside said first body end and attached to said first rod end and said push button actuator, for biasing said rod toward said handle, said push button actuator into a non-depressed position, and said first opposing jaw and said second opposing jaw to a closed position.

3. The hand-held toilet paper gripping device recited in claim 2, further comprising:

a jaw actuator comprising:

a first opposing connector having a first jaw connector end and a first extension end, said first jaw connector end being pivotally attached to said second rod end;

a first opposing jaw extension having a first end and a second end, said first end being pivotally connected to said first extension end, a second end being attached to said first opposing jaw;

a second opposing connector having a second jaw connector end and a second extension end, said second jaw connector end being pivotally attached to said second rod end; and a second opposing jaw extension having a first terminus and a second terminus, said first terminus being pivotally connected to said second extension end, and said second terminus being attached to said second opposing jaw.

4. The hand-held toilet paper gripping device recited in claim 3, wherein when said push button actuator is depressed and said rod is displaced toward said second body end, said first opposing connector and said second opposing connector are moved from an inclined position to an upright position, thereby causing said first opposing jaw and said second opposing jaw to be raised to an open position.

5. The hand-held toilet paper gripping device recited in claim 1, wherein said handle, said elongated tubular body portion, and said jaw assembly are made of stainless steel.

6. A hand-held toilet paper gripping device comprising:

a stainless steel curved tubular body portion having a first body end and a second body end;

a stainless steel toilet tissue gripping apparatus affixed to said second body end for grasping a sheet of toilet tissue;

a stainless steel handle affixed to said first body end; and a stainless steel jaw actuating mechanism operably attached to each of said handle, said curved tubular body portion, and said toilet tissue gripping apparatus for selectively actuating said toilet tissue gripping apparatus between an opened position and a closed position for gripping toilet tissue.

* * * * *